United States Patent [19]
Chang
[11] 4,294,366
[45] Oct. 13, 1981

[54] FREE-STANDING PLASTIC BOTTLE

[75] Inventor: Long F. Chang, Sylvania, Ohio

[73] Assignee: Owens-Illinois, Inc., Toledo, Ohio

[21] Appl. No.: 130,777

[22] Filed: Mar. 17, 1980

[51] Int. Cl.[3] ..... B65D 23/00; B65D 1/02
[52] U.S. Cl. ..... 215/1 C; 220/70
[58] Field of Search ..... 215/1 C; 150/15; 220/70

[56] References Cited

U.S. PATENT DOCUMENTS

| | | | |
|---|---|---|---|
| D. 254,957 | 5/1980 | Campbell | 220/70 |
| 2,372,177 | 3/1945 | Conner | 215/1 C |
| 3,598,270 | 8/1971 | Adomaitis | 220/70 |
| 3,727,783 | 4/1973 | Carmichael | 220/70 |
| 3,811,588 | 5/1974 | Vermeerbergen | 215/1 C |
| 3,935,955 | 2/1976 | Dar | 215/1 C |
| 4,108,324 | 8/1978 | Kresbnakumar | 220/70 |

FOREIGN PATENT DOCUMENTS

| | | | |
|---|---|---|---|
| 1571499 | 6/1969 | France | 215/1 C |

OTHER PUBLICATIONS 2,014,108A, Published 8-1979, UK Patent Application GB, Inventor is Chercbian.
2082, Published 5-1979, European Patent Office, the Inventor is Dechenne.

*Primary Examiner*—Herbert F. Ross
*Attorney, Agent, or Firm*—S. M. McLary; Myron E. Click; David H. Wilson

[57] ABSTRACT

A plastic container comprising a side wall having an oriented generally cylindrical lower portion, and a bottom joined to said side wall and closing the lower end of the container. The bottom includes a generally elliptical bottom wall and a plurality of oriented circumferentially spaced outwardly convexed legs extending from the elliptical wall. The elliptical wall has a first portion extending downwardly from the lower cylindrical side wall portion and having a radius less than the diameter of the container. Each leg has a first convex portion extending downwardly from the cylindrical portion of the side wall and having a radius greater than the diameter of the cylindrical portion. Each leg has diverging side wall portions merging radially inwardly with the elliptical wall portion of the bottom wall.

4 Claims, 11 Drawing Figures

FREE-STANDING PLASTIC BOTTLE

BACKGROUND AND SUMMARY OF THE INVENTION

This invention relates to the base designs of pressurized free-standing plastic containers. The base consists of three or more outwardly convexed legs to support the bottle standing upright.

A bottle generally consists of a shoulder portion with an opening, a sidewall or main body which is generally cylindrical in shape, and a bottom joining the sidewall. Because of the tendency of the wall of the pressurized plastic bottle to creep under internal pressure, it is a general practice to orient the plastic material and to design the bottle shape in such a way to improve resistance against creep. For the bottom section, it is known that if a uniform material distribution is achieved, the stress caused by the internal pressure can be minimized by using an outwardly hemispherical configuration. This bottom configuration, however, requires a separate means of support to make the bottle stand upright. For this purpose, a base cup is normally used.

Molecular orientation can be obtained by blowing a properly designed parison in a blow mold in the orientation temperature region. Normally, when a parison is blown in a bottle mold, the bottom portion near its center is somewhat thicker. To make full use of the material in the bottom area, the bottom shape can be made elliptical rather than spherical. Further, and importantly, such an elliptical configuration tends to make the tensile stress distribution in the bottom region more uniform.

One simple way to make a free-standing bottle is to use a champagne push-up bottom to creat a seating ring. One type of container incorporating such a construction is shown in U.S. Pat. No. 3,881,621. The difficulty with this method is that the bending force caused by the internal pressure tends to deform the structure and roll out the push-up portion near the seating ring. This results in a decrease of the size of seating ring reducing the bottle stability and also resulting in an increase of the length of the bottom. This type of deformation could eventually result in rocker bottom.

Another way to provide a self-support for the bottle is to incorporate into the bottom, three or more outwardly convexed legs disposed around the center pole of the bottom. Typical designs that have been proposed for such construction are shown in U.S. Pat. Nos. 3,598,270, 3,871,541 and 3,935,955. One objective of this invention is to provide such a design to provide a free-standing base for an oriented pressurized plastic container.

When a free-standing bottle with such a base structure is dropped from a certain height, the leg which hits the floor first tends to crack due to the impact. It is known that increased degree of orientation in the leg tip region tends to increase resistance against such an impact. Another objective of this invention is to incorporate enough orientation in the tip region of the legs to improve the impact strength of the bottom.

This type of free-standing base may still develop rocker bottom under internal pressure and high temperature. To increase the safety margin against such a rocker bottom problem, the clearance between the center of the bottom and the horizontal plane on which the legs stand should be large. In accordance with the invention, this is achieved by using an elliptical bottom to shorten the length of the bottom on one hand and by incorporating a small outwardly concave region at the center of the bottom on the other.

Since an outwardly concaved structure is less stable than an outwardly convexed structure, it is desirable to design a free-standing base with minimum portion of the outwardly concaved structure. This is achieved in this invention by using a relatively large portion of the elliptical bottom and by reducing the area of the transition region joining the main elliptical portion and the legs.

DESCRIPTION OF THE PREFERRED EMBODIMENTS

Figure 1:
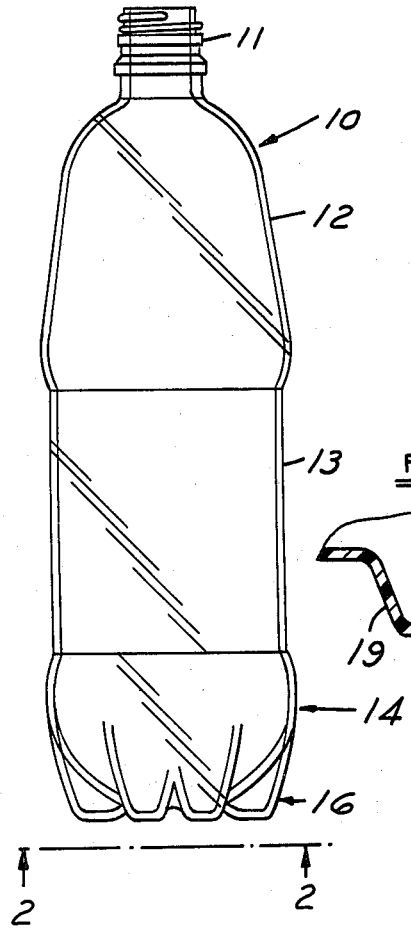
FIG. 1 is an elevational view of a plastic container embodying the invention.
Figure 2:
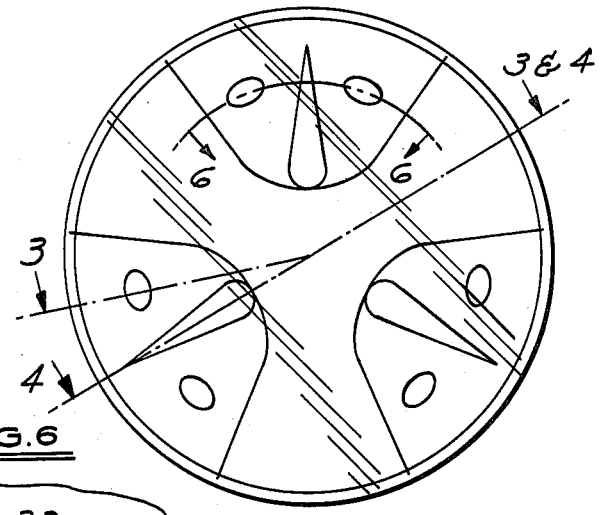
FIG. 2 is a view taken along the line 2—2 in FIG. 1.
Figure 6:
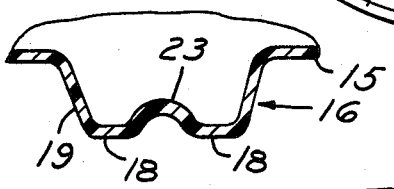
FIG. 6 is a fragmentary sectional view taken along the line 6—6 in FIG. 2.

Referring to FIG. 1, the plastic container 10 embodying the invention is made of suitable plastic material which can be oriented when blown at the orientation temperature in accordance with well known methods such as in U.S. Pat. No. 3,294,885 wherein a parison is injection molded, cooled to room temperature, reheated to the orientation temperature, and then blown in a mold to form the container. Alternatively, the container may be formed by injection molding a parison, cooling the parison to the orientation temperature and blowing the parison in a mold as shown in U.S. Pat. No. 3,470,282.

When a container is made in accordance with such a method, it comprises a neck 11, shoulder 12, side wall 13, the lower end of which is cylindrical, and a bottom 14.

Figure 3:
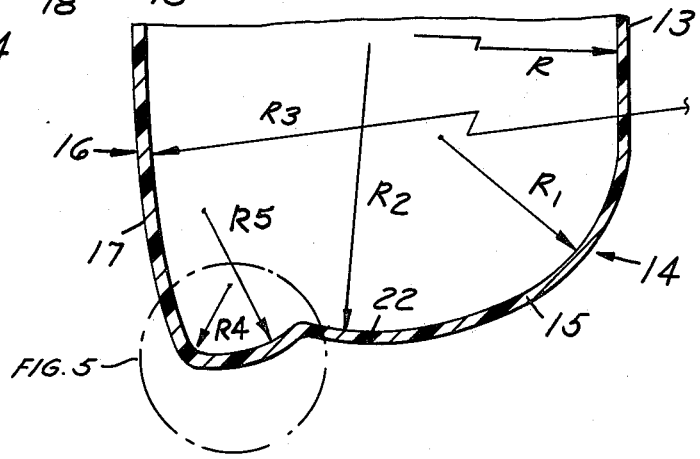
FIG. 3 is a fragmentary sectional view taken along the line 3—3 in FIG. 2.

In accordance with the invention, the bottom 14 is generally elliptical. As shown in FIG. 3, the elliptical portion of the bottom 14 includes a first portion having a radius $R_1$ which merges with the lower end of the cylindrical portion of the side wall 13 and has a radius less than the radius R of the cylindrical portion of the side wall 13. The elliptical portion of the bottom 14 further includes a second portion having a radius $R_2$ which is greater than the radius $R_1$ or radius R and blends toward the center of the elliptical portion. The center of radius $R_1$ is displaced from the center line of the container while the center of the radius $R_2$ lies along the center line of the radius.

The bottom 14 further includes a plurality of circumferentially spaced integral legs 16, each of which has an outer convex surface 17 extending downwardly to a contacting portion 18 and side walls 19 extending radially inwardly and diverging from the outer convex surface 17 to the elliptical portion 15 of the bottom 14.

As shown in FIG. 3, the upper portion of the outer convex surface 17 has a radius $R_3$ which is greater than the diameter of the cylindrical portion of the container and a lower portion which has a radius $R_4$ that is substantially less than the radius R of the cylindrical portion of the container.

Figure 5:
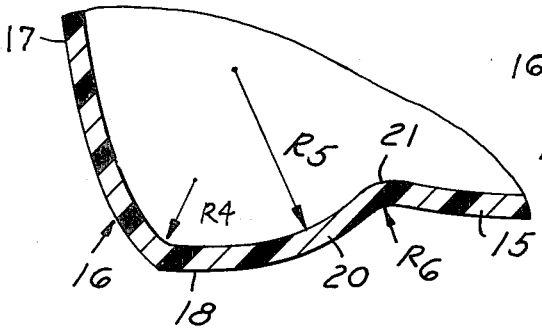
FIG. 5 is an enlarged view of a portion shown in the circle in FIG. 3.

Each leg further includes a portion 20 which is convex outwardly and has a radius $R_5$ as shown in FIG. 5, wherein $R_5$ is greater than $R_4$. Finally, a portion 21 which is convexed outwardly and has a small radius $R_6$ which blends with portion 20 and the elliptical portion 15 of the bottom 14.

Preferably, the centermost portion of the elliptical portion 15 of the bottom 14 as at 22 is convex upwardly, that is, it has a radius, the center of which is external of the container along the center line thereof.

Figure 4:
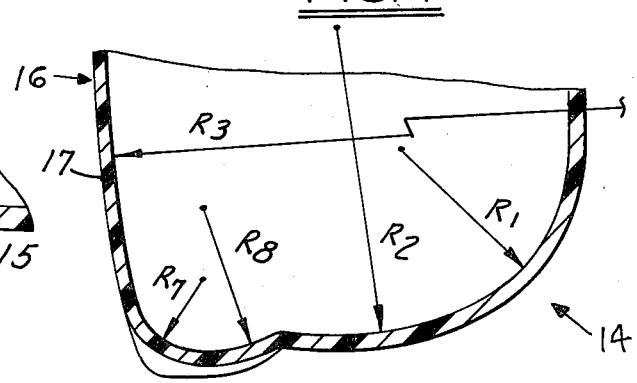
FIG. 4 is a fragmentary sectional view taken along the line 4—4 in FIG. 2.
Figure 7:
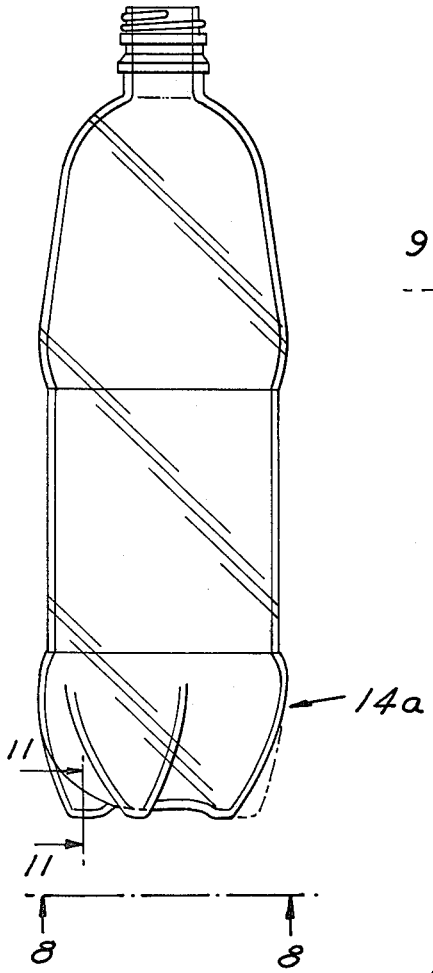
FIG. 7 is an elevational view of a modified form of plastic container embodying the invention.
Figure 8:
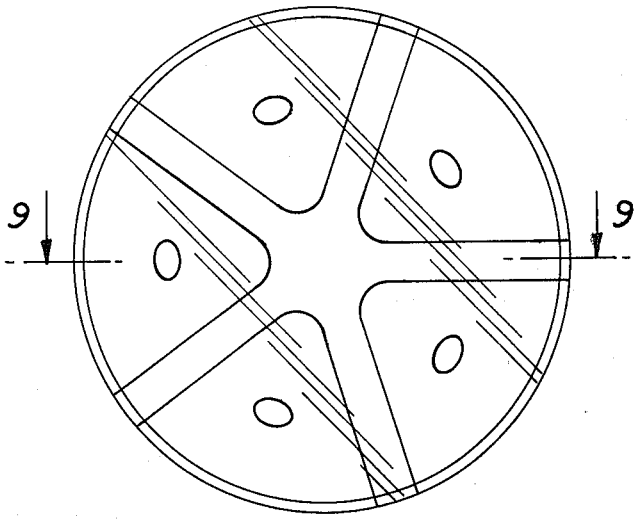
FIG. 8 is a view taken along the line 8—8 in FIG. 7.

In the form shown in FIGS. 1–6, the surface contacting portion 18 is preferably divided by an upwardly extending portion 23 (FIG. 6) so that the meridian therethrough is curved as shown in FIG. 4 and the lower portion of the outer convex surface 17 has a radius $R_7$ and $R_8$, each of which is less than the radii $R_4$, $R_5$.

Figure 9:
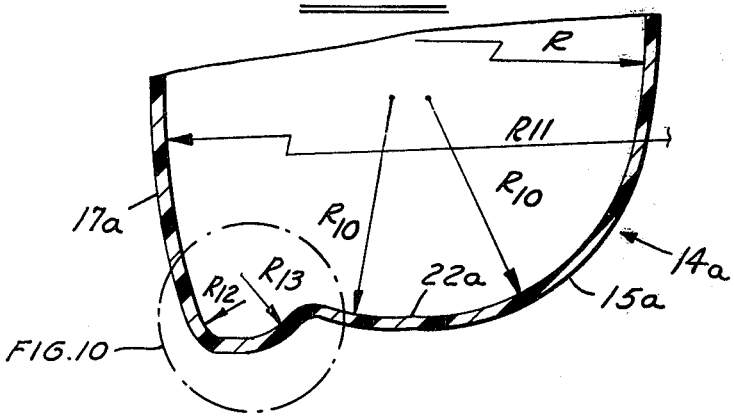
FIG. 9 is a fragmentary sectional view taken along the line 9—9 in FIG. 8.
Figure 10:
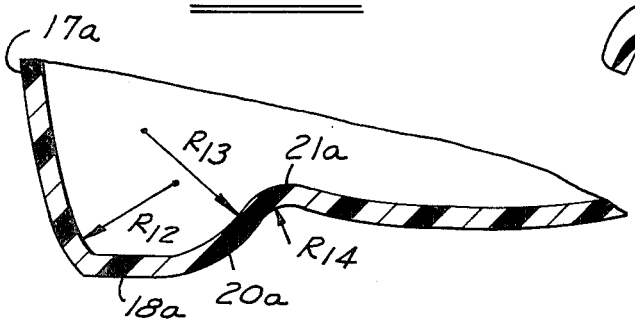
FIG. 10 is a fragmentary enlarged view in the area of the circle shown in FIG. 9.
Figure 11:
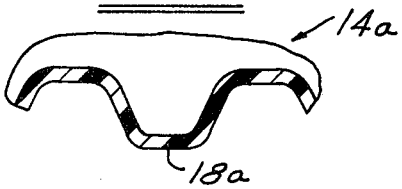
FIG. 11 is a fragmentary sectional view taken along the line 11—11 in FIG. 7.

In the form of the invention shown in FIGS. 7–11, the bottom 14*a* is generally elliptical as in the previous form of the invention. More specifically, as shown in FIG. 9, the elliptical portion 15*a* comprises two parts, each of which has a radius $R_{10}$ displaced from the center line of the container, blending with the lowermost portion of the cylindrical wall of the container and intersecting at the center of the bottom. A portion 22*a* having a radius with its center externally of the container along the center line of the container provides a concave upwardly configuration to the centermost portion of the elliptical part 15*a* of the bottom.

In the form shown in FIGS. 7–11, each of the legs has an outwardly convex surface 17*a* extending to contacting portion 18*a*, a portion 20*a* and 21*a* as in the previous form but the division of a leg into contacting portions is eliminated. As in the previous form, the outer convex surface 17*a* is defined by a radius $R_{11}$ which is greater than the diameter of the cylindrical portion of the container. A lower portion of the outer convex surface 17*a* has a radius $R_{12}$ and blends with the surface contacting portion 18*a*. A convex outwardly portion having a radius $R_{13}$ blends with the contacting portion and with a concave portion 21*a* having a radius $R_{14}$.

Each of the forms of the invention is made by blowing a parison in a mold while the parison is at the orientation temperature. As a result the portions of the legs which are blown outwardly beyond the elliptical bottom are oriented to a greater degree than the elliptical bottom.

I claim:

1. A plastic container comprising a side wall having an oriented generally cylindrical lower portion, and a bottom joined to said side wall and closing the lower end of said container, said bottom including a generally elliptical bottom wall and a plurality of oriented circumferentially spaced outwardly convexed legs extending from the elliptical wall, said elliptical wall having a first portion extending downwardly from the lower cylindrical side wall portion and having a radius less than the diameter of the container, said elliptical wall having a central portion, each said leg having a first oriented portion extending downwardly from the cylindrical portion of the side wall and having a radius greater than the diameter of the cylindrical portion of the side wall, a second oriented portion extending downwardly from said first portion of said leg and having a radius substantially less than the radius of said cylindrical portion, a third oriented portion extending from said second portion defining a flat contacting portion, a fourth oriented portion extending upwardly and inwardly from said flat portion and being convex outwardly, a fifth oriented portion blending with said fourth portion and the central portion of the bottom wall, the radius of said fourth portion being greater than the radius of said second portion, the first and second portions of each said leg defining an outwardly extending convex surface, each said leg having diverging oriented side wall portions merging radially inwardly with the elliptical wall portion of the bottom wall.

2. The plastic container set forth in claim 1 wherein each said leg further includes an intermediate portion extending upwardly and being concave outwardly thereby dividing the contacting portion of said leg into a pair of contacting portions, said intermediate portion being spaced vertically between said elliptical wall portion and said contacting portions, the meridian section through said intermediate portion comprising a curved cross section blending with the first portion of said leg and blending with said fifth portion.

3. The plastic container set forth in claim 1 wherein said bottom wall includes a central portion which is convex downwardly and has a radius along the center line of the container.

4. The plastic container set forth in claim 1 wherein said bottom wall includes a central portion which is concave upwardly and has a radius along the center line of the container.

* * * * *